US011002074B1

(12) United States Patent
Calleri

(10) Patent No.: US 11,002,074 B1
(45) Date of Patent: May 11, 2021

(54) CONTINUOUS CIRCULATION AND ROTATION DRILLING SYSTEM

(71) Applicant: Geolog Americas Inc., Houston, TX (US)

(72) Inventor: Antonio Calleri, Houston, TX (US)

(73) Assignee: Geolog Americas Inc., Houston, TX (US)

( * ) Notice: Subject to any disclaimer, the term of this patent is extended or adjusted under 35 U.S.C. 154(b) by 0 days.

(21) Appl. No.: 16/785,681

(22) Filed: Feb. 10, 2020

(51) Int. Cl.

| | |
|---|---|
| ***E21B 3/00*** | (2006.01) |
| ***E21B 3/02*** | (2006.01) |
| ***E21B 21/10*** | (2006.01) |
| ***E21B 21/12*** | (2006.01) |
| ***E21B 21/08*** | (2006.01) |
| *E21B 19/00* | (2006.01) |

(52) U.S. Cl.
CPC ..... *E21B 3/022* (2020.05); *E21B 21/08* (2013.01); *E21B 21/10* (2013.01); *E21B 21/103* (2013.01); *E21B 21/106* (2013.01); *E21B 21/12* (2013.01); *E21B 19/00* (2013.01)

(58) Field of Classification Search
CPC ..... E21B 21/08; E21B 21/10; E21B 21/106; E21B 19/00; E21B 3/022
See application file for complete search history.

(56) References Cited

U.S. PATENT DOCUMENTS

| | | | | |
|---|---|---|---|---|
| 10,794,130 | B2 * | 10/2020 | Johnson | E21B 21/08 |
| 2009/0025930 | A1 * | 1/2009 | Iblings | E21B 21/002 166/244.1 |
| 2010/0252272 | A1 * | 10/2010 | Haughom | E21B 21/106 166/373 |
| 2014/0202767 | A1 * | 7/2014 | Feasey | E21B 21/08 175/57 |

* cited by examiner

*Primary Examiner* — Tara Schimpf

(57) ABSTRACT

Continuous circulation and rotation drilling system, comprising: a top drive; a mud circulation system; a drill assembly including a drill pipe; a clamp device. The continuous circulation and rotation drilling system is drivable between a first condition and a second condition. In the first condition, the drill assembly and the clamp device are mutually disconnected. In the second condition: the main body of the clamp device is in a closed configuration and the drill assembly is partly enclosed in an inner housing of the clamp device; the mud circulation system feeds drilling mud through a radial opening of a main body of the clamp device; one or more actuating groups of the clamp device are activated to rotate the drill pipe around its longitudinal axis.

17 Claims, 11 Drawing Sheets

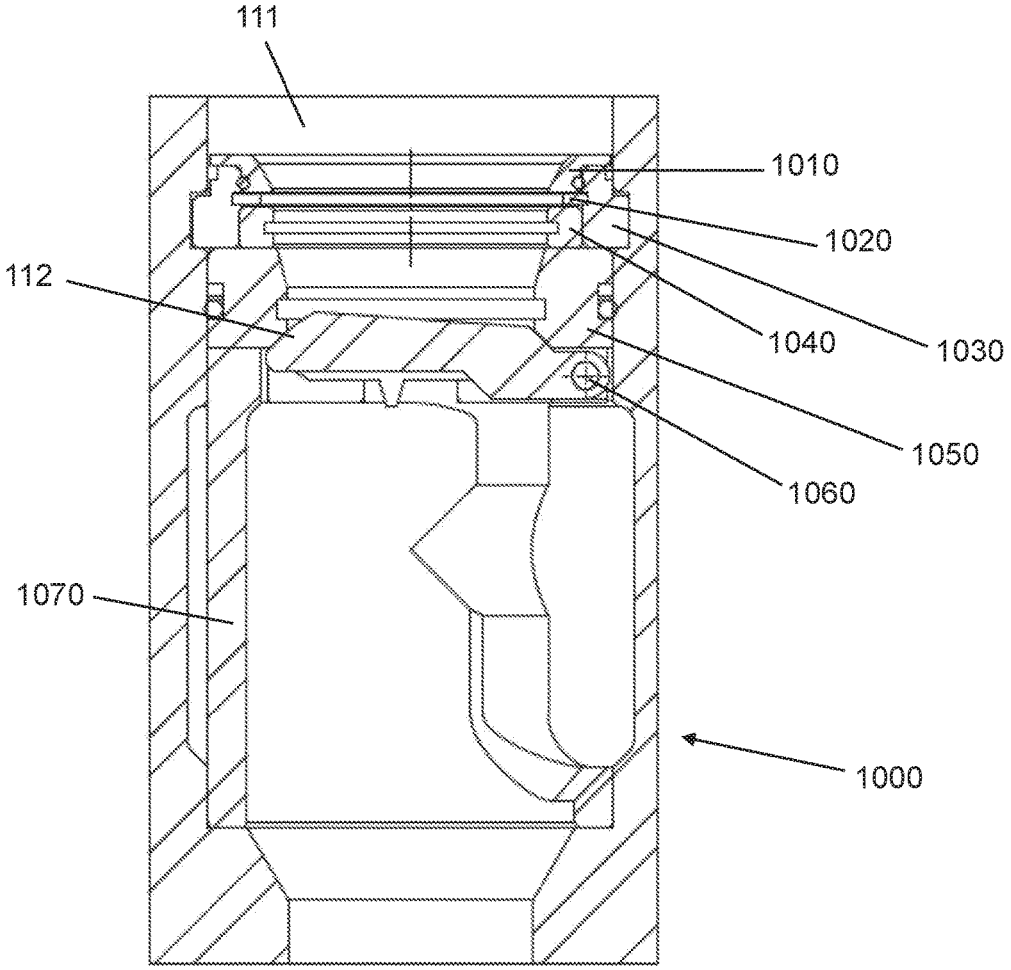
FIG. 6
FIG. 7
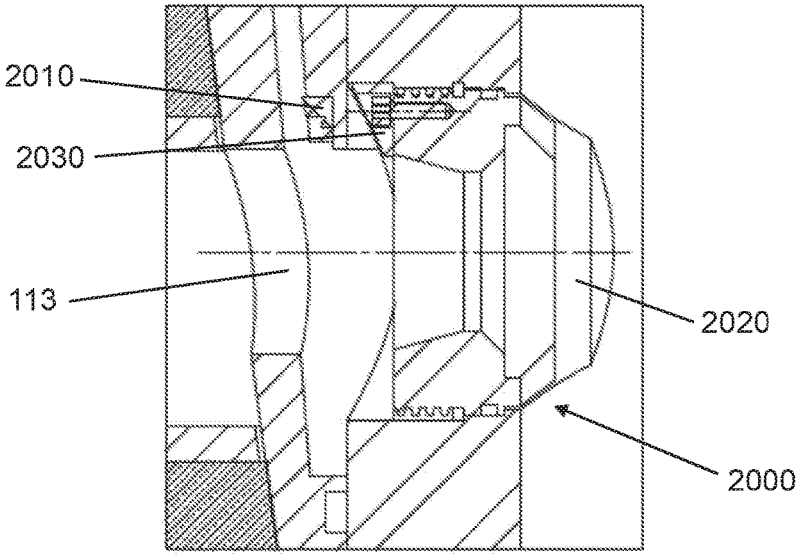

FIG. 10
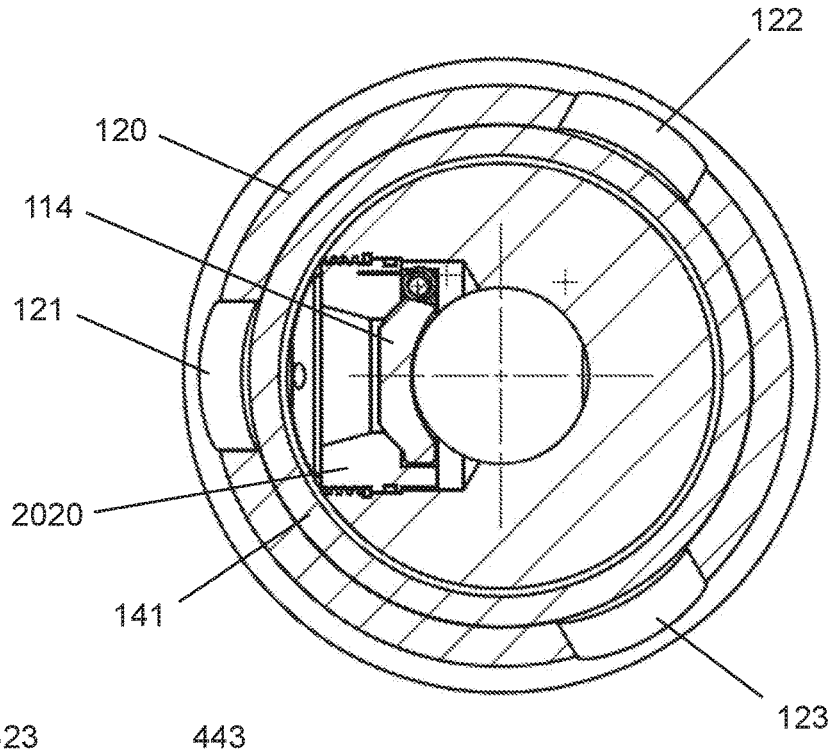
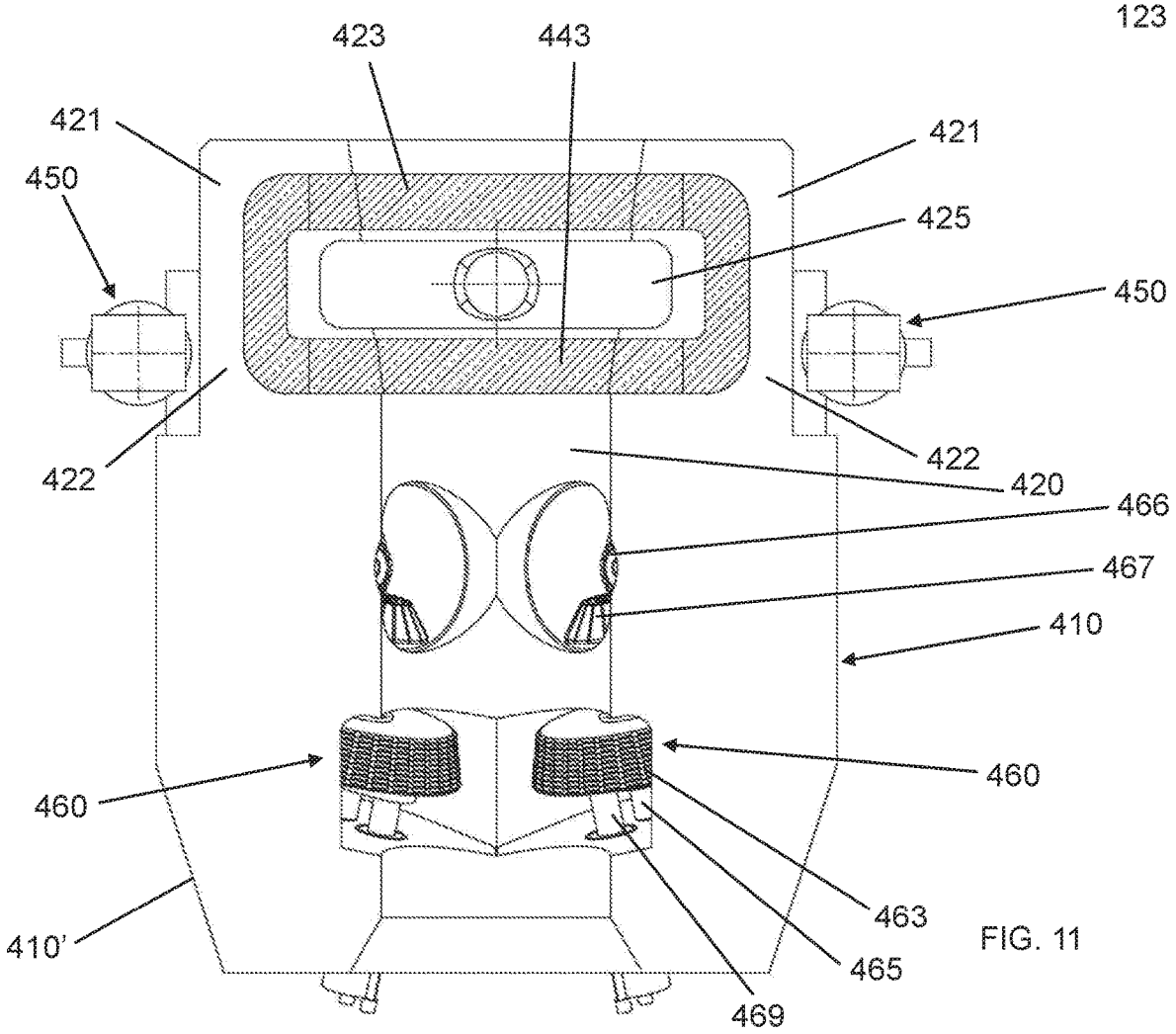
FIG. 11

CONTINUOUS CIRCULATION AND ROTATION DRILLING SYSTEM

FIELD AND BACKGROUND OF THE INVENTION

The present invention relates to a continuous circulation and rotation drilling system.

The drilling of soil is commonly performed with a rotary system, i.e. using a rotating drill bit screwed to the end of a progressive series of drill pipes.

Rotation is provided by a top drive, which is connected to the top end of the drill string assembly.

While drilling, a drilling fluid (typically, a drilling mud) is circulated, so as to lubricate the drill bit, maintain an adequate hydrostatic pressure inside the well and allow an easy removal of cuttings from the wellbore.

As the drill bit penetrates into the earth and as the wellbore gets deeper, more drill pipes have to be added.

This requires the stopping of the drilling activity (i.e. the circulation and rotation operations), in order to disconnect the top drive from the currently used drill pipe, position and connect a new drill pipe to the top end of the currently used pipes, and finally connect the top drive to the newly added drill pipe.

The Applicant notes that interrupting the drilling operations is highly undesirable for a number of reasons, the latter including a worsened removal of cuttings from the well causing a deterioration of the cleaning performance, and a decrease of the pressure exerted onto the subsoil being drilled, possibly causing drilling issues including kicks.

Methods and systems are known which permit not to stop the rotation of the drill bit and the circulation of the drilling mud while adding new segments to the drill string assembly.

However, the Applicant notes that the known techniques are not fully satisfactory in terms of reliability, safety and easiness to be employed.

SUMMARY OF THE INVENTION

An object of the present invention is to provide a technique which allows the addition of a drill sting in a drilling system with continuous circulation and rotation in a reliable, safe and easy way.

This and other objects are achieved by a continuous circulation and rotation drilling system, comprising:

a top drive;

a mud circulation system;

a drill assembly, including a continuous circulation sub and a drill pipe;

the continuous circulation sub including: a substantially cylindrical tube having an axial aperture for axial mud feeding, an axial valve for selectively opening said axial aperture, a radial aperture for radial mud feeding, a radial valve for selectively opening said radial aperture; a sleeve partly surrounding said cylindrical tube and having at least one radial port; one or more bearing elements radially interposed between said cylindrical tube and said sleeve, said one or more bearing elements allowing mutual rotation between the substantially cylindrical tube and the sleeve;

the drill pipe having a top end;

the substantially cylindrical tube of the continuous circulation sub being integrally engaged to the top end of the drill pipe;

the continuous circulation and rotation drilling system further comprising a clamp device, including:

a main body having a radially inner axially open cylindrical hollow space defining an inner housing, the main body being formed by a first part and a second part, the main body being drivable between an open configuration wherein the first part and second part are spaced apart, and a closed configuration wherein the first part and the second part are joined together to form said inner housing;

one or more actuators configured to drive the main body in the open and closed configuration;

one or more actuating groups mounted to said main body;

the main body having a radial opening configured for receiving a radial flow of drilling mud;

said continuous circulation and rotation drilling system being drivable between a first condition and a second condition, wherein in the first condition:

said drill assembly and said clamp device are mutually disconnected, said drill assembly is rotated by said top drive, said axial valve is open and said mud circulation system feeds mud through the axial aperture of the continuous circulation sub;

said radial valve closes said radial aperture;

in the second condition:

the main body of the clamp device is in the closed configuration and the drill assembly is partly enclosed in said inner housing;

the top drive is disconnected from the drill assembly;

the axial valve closes the axial aperture of said continuous circulation sub;

the radial valve is open and the mud circulation system feeds drilling mud through the radial opening of the main body of the clamp device and the radial aperture of the continuous circulation sub;

said one or more actuating groups are activated to rotate the drill pipe around its longitudinal axis.

Preferably, said sleeve has a substantially cylindrical upper portion and a tapered lower portion, said inner housing having one or more portions having a shape substantially complementary with respect to respective parts of the lower portion of said sleeve wherein, when said sleeve is enclosed in said inner housing, said sleeve is blocked by said inner housing and said cylindrical tube can rotate with respect to said sleeve and with respect to said main body.

Preferably, said one or more portions of the inner housing comprise a first portion and a second portion, each of said first portion and second portion being coupled to a respective first and second seal, said first and second seal being energized by the tapered portion of said sleeve in the first and second portions of said inner housing.

Preferably, said inner housing has a radially enlarged portion, arranged between said first portion and said second portion, said radially enlarged portion defining a mud flowing chamber when the continuous circulation and rotation drilling system is in the second condition.

Preferably, when said continuous circulation and rotation drilling system is in the second condition, the at least one radial port of said sleeve, the radial aperture of said substantially cylindrical tube and the radial opening of said main body are in fluid communication with said mud flowing chamber.

Preferably, when said continuous circulation and rotation drilling system is in the second condition, said first and second seal provide a tight closure to a region in which said mud flowing chamber extends.

Preferably, when said continuous circulation and rotation drilling system is in the second condition, the at least one radial port of said sleeve, the radial aperture of said substantially cylindrical tube and the radial opening of said main body are in fluid communication with each other.

Preferably, said continuous circulation sub comprises an axially slidable valve, including an annular element radially interposed between the sleeve and the cylindrical tube, and an active element coupled to said annular element.

Preferably, the axially slidable valve is drivable between an obstruction condition, wherein the annular element closes said radial aperture, and an enabling condition, wherein the annular element does not close the radial aperture.

Preferably, when the continuous circulation and rotation drilling system is in the first condition, said active element maintains the axially slidable valve in the obstruction condition and, when the continuous circulation and rotation drilling system is in the second condition, a pressure exerted by the mud flow through the radial aperture of the main body causes the annular element to axially slide and drives the axially slidable valve in the enabling condition.

Preferably, said one or more bearing elements comprise a first bearing element located at a top section of said sleeve, and a second bearing element located at a bottom section of said sleeve.

Preferably, each of said one or more actuating groups comprise:

a motor, having a substantially horizontal output shaft;

a roller, rotated by said motor and having a radially outer surface, wherein, when the continuous circulation and rotation drilling system is in the second condition, the radially outer surface of said roller is in contact with the drill pipe in a contact region and causes a rotation of said drill pipe.

Preferably, each of said actuating groups comprise:

a roller shaft, on which said roller is fitted;

a first bevel gear mounted on the output shaft of said motor;

a second bevel gear mounted on the roller shaft and coupled to the first bevel gear.

Preferably, said roller is axially slidable along said roller axis, each actuating group comprising:

a supporting element arranged on said roller shaft and configured to axially drive said roller along said roller shaft;

an auxiliary actuator configured to axially displace said supporting element.

Preferably, said supporting element has a groove formed on an outer surface of said supporting element; said auxiliary actuator comprises a rectilinearly moving element, the latter having a protrusion, said protrusion being coupled to said groove.

Preferably, said roller shaft has a longitudinal axis inclined with respect to a longitudinal axis of said substantially cylindrical tube and said drill pipe, wherein the outer surface of said roller has a tapered shape such that, when the continuous circulation and rotation drilling system is in the second condition, the outer surface of the roller has a profile, in said contact region, that is parallel to the longitudinal axis of said substantially cylindrical tube and said drill pipe.

Preferably, said main body has a bottom tapered section for fitting in a master bushing of a rotary table.

BRIEF DESCRIPTION OF THE SEVERAL VIEWS OF THE DRAWINGS

Further features and advantages will become apparent in view of the description of preferred embodiments on the invention provided in the following, in connection with the attached drawings. It has to be noted that both the detailed description and the drawings show non-limiting examples of the present invention and are not intended to have any limiting purpose.

FIG. 6 is an enlarged view of a first detail of FIG. 5;

FIG. 7 is an enlarged view of a second detail of FIG. 5;

FIG. 10 is a cross-sectional view, according to sectional plane X-X, of the portion shown in FIG. 9;

FIG. 11 is a side view of the portion shown in FIG. 2, wherein some parts have been deleted;

DESCRIPTION OF SPECIFIC EMBODIMENTS OF THE INVENTION

Figure 1:
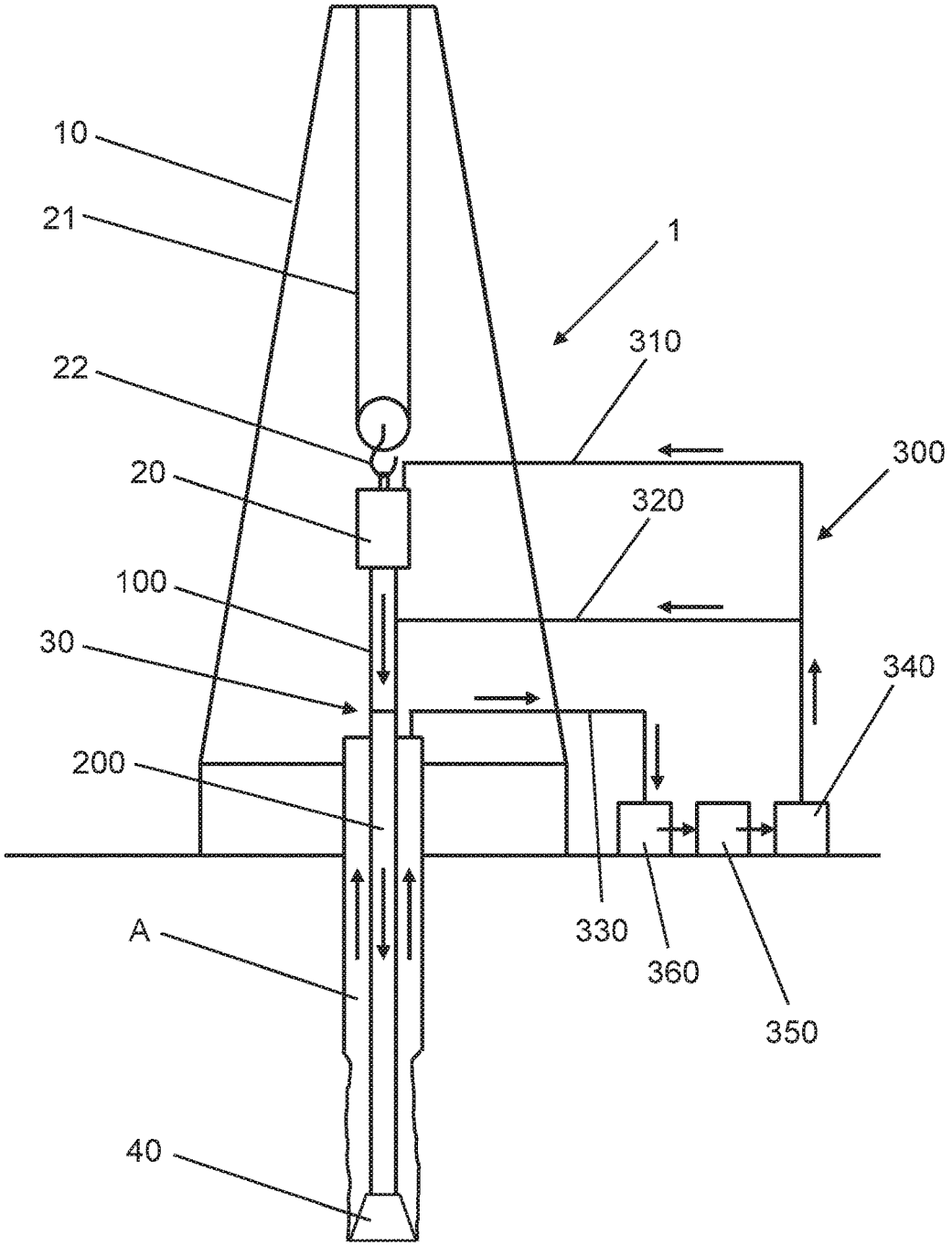
FIG. 1 schematically shows a continuous circulation and rotation drilling system according to the present invention.
Figure 2:
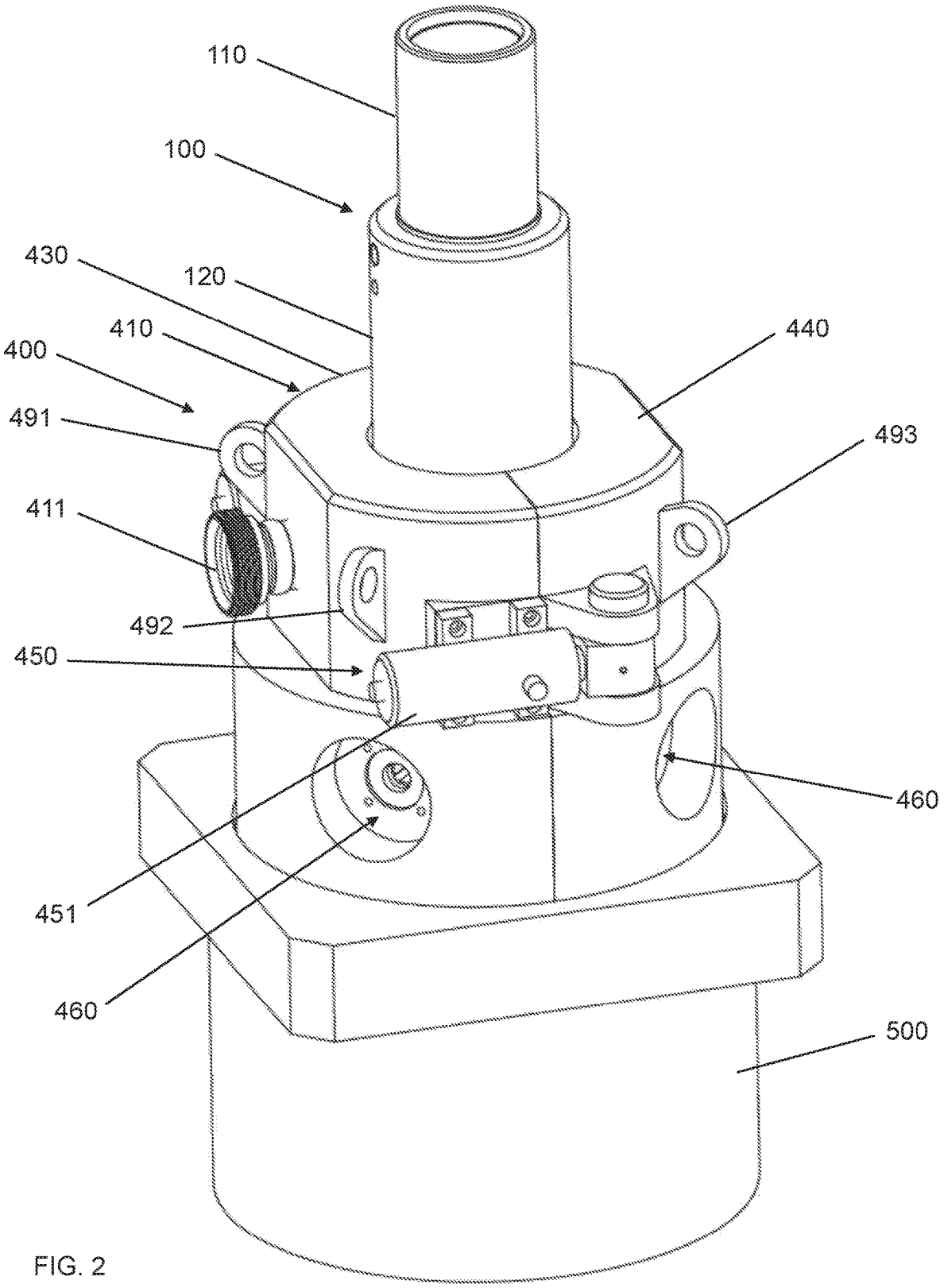
FIG. 2 is a perspective view of a portion of the system of FIG. 1.
Figure 3:
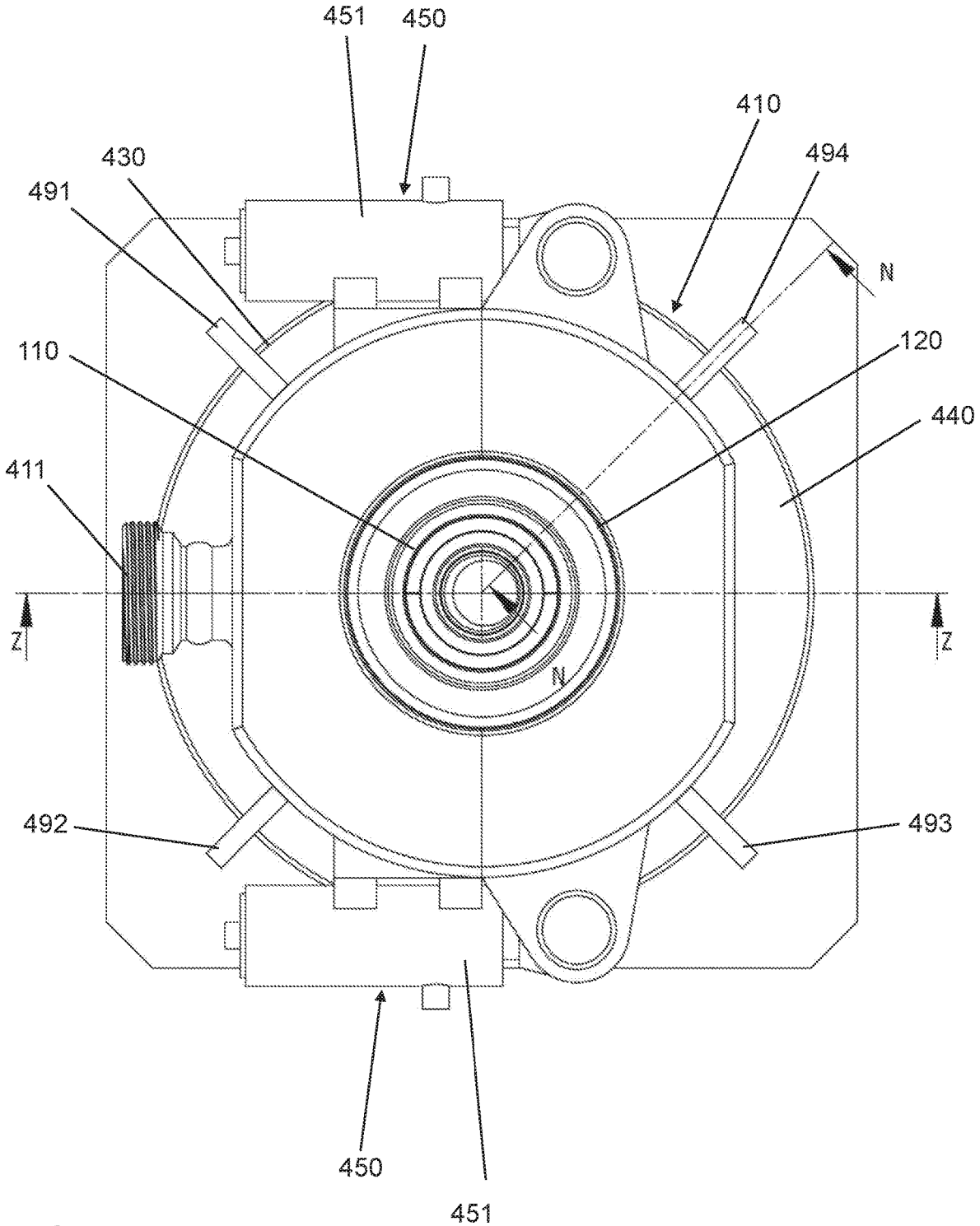
FIG. 3 is a top view of the portion shown in FIG. 2.

With reference to the annex drawings, a continuous circulation and rotation drilling system according to the present invention is designated at 1.

System 1 (FIG. 1) comprises a support structure 10, usually referred to as "derrick".

The support structure 10 supports a top drive 20, by means of a vertical movement member 21 and a hook 22. The vertical movement member 21 preferably comprises a block and tackle system, at the bottom of which the hook 22 is engaged. The top drive 20 is hung on the hook 22. The vertical movement member 21 is driven so as to lift/lower the hook 22 and, consequently, the top drive 20.

System 1 further comprises a drill assembly 30.

The drill assembly 30 is engaged, at a top end thereof, to the top drive 20 and at a bottom end thereof, to a drilling bit 40.

The drill assembly 30 transfers the rotary motion generated by the top drive 20 to the drilling bit 40.

Figure 5:
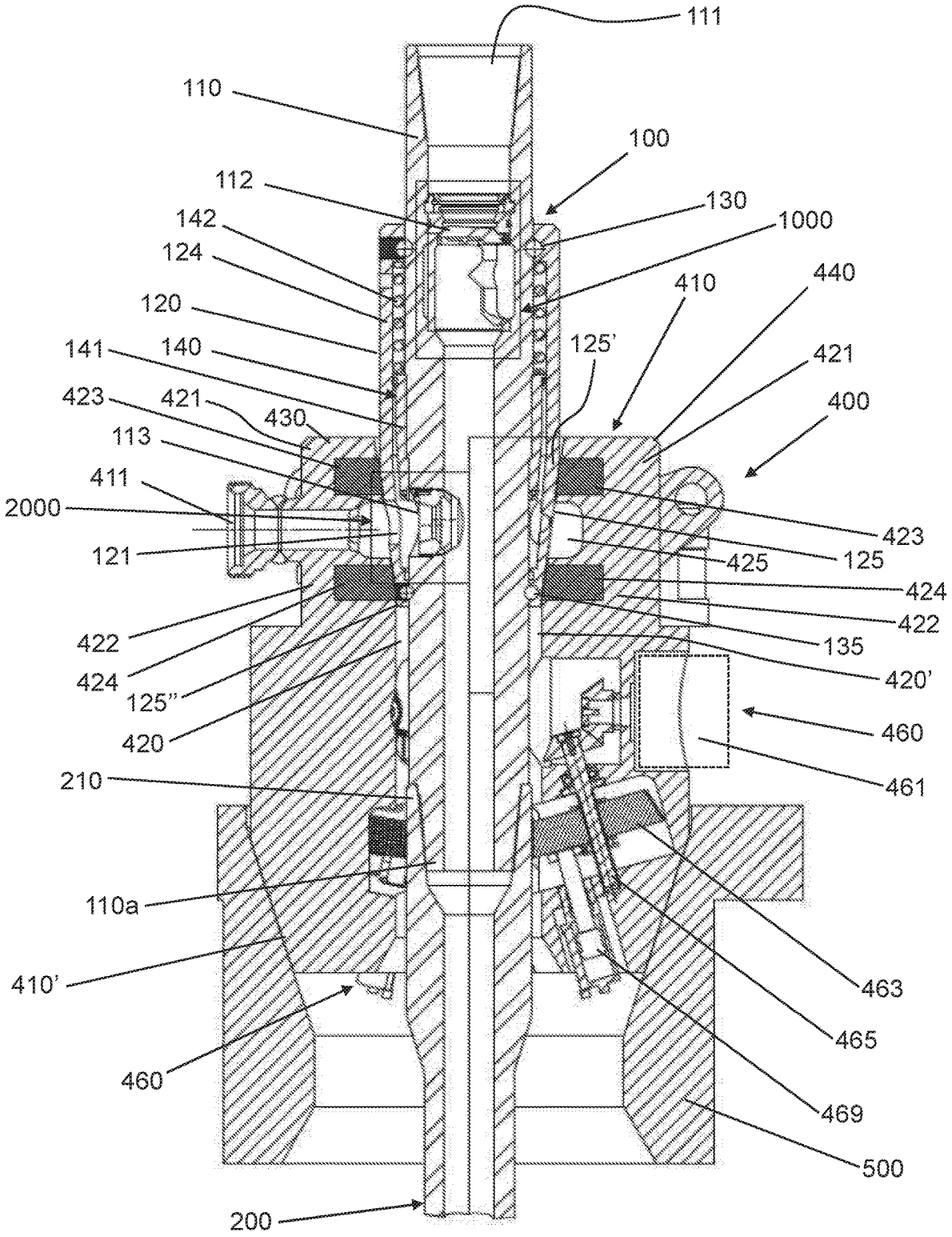
FIG. 5 is a cross-sectional view, according to sectional planes N-N and Z-Z, of the portion shown in FIGS. 2 and 3.
Figure 8:
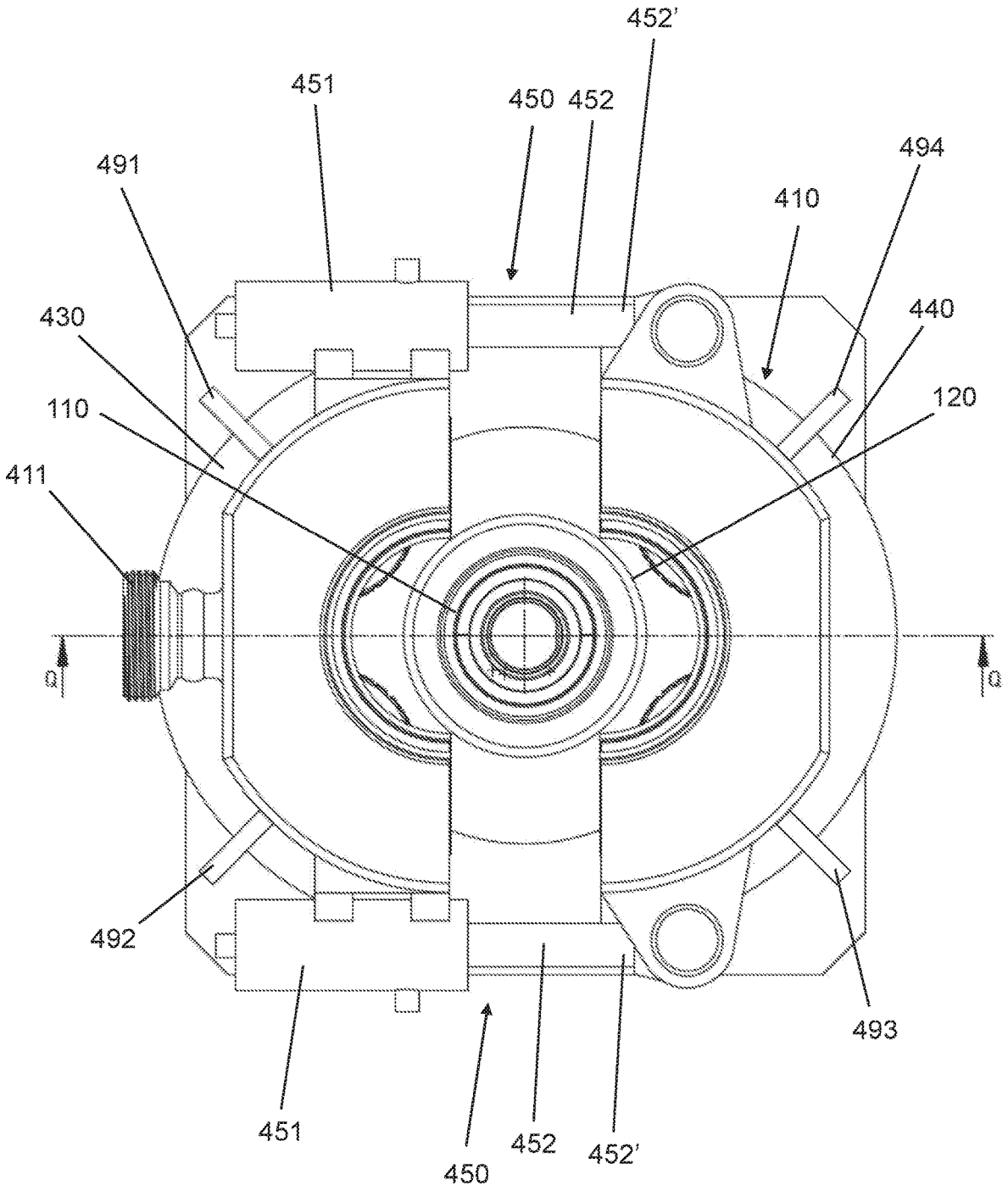
FIG. 8 shows the portion shown in FIG. 3 in a different configuration.
Figure 9:
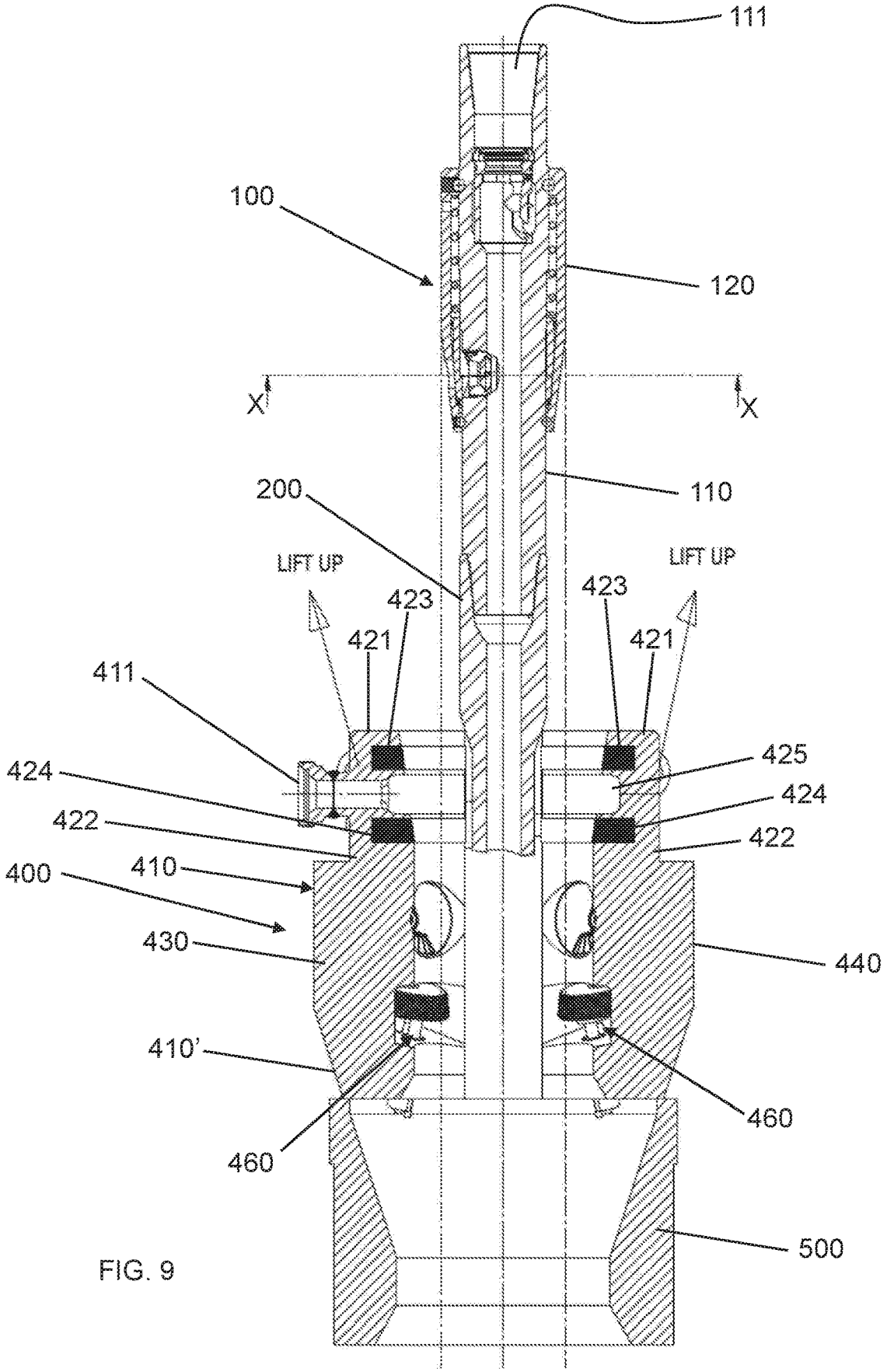
FIG. 9 is a cross-sectional view, according to sectional plane Q-Q, of the portion shown in FIG. 8.

The drill assembly 30 comprises a continuous circulation sub 100 and a drill pipe 200 (FIGS. 1, 5 and 9).

The continuous circulation sub 100 includes a substantially cylindrical tube 110.

The substantially cylindrical tube 110 has an axial aperture 111 for axial mud feeding.

The substantially cylindrical tube 110 comprises an axial valve 112 for selectively opening said axial aperture 111.

In one embodiment, the axial valve 112 can be realized as a first flapper which is operable between a vertical orientation and a horizontal orientation.

In the vertical orientation, the first flapper (i.e. the axial valve 112) leaves the axial aperture 111 open, so that the drilling mud can flow in axial direction through the substantially cylindrical tube 110 and the drill pipe 200, to the drilling bit 40.

In the horizontal orientation, the first flapper (i.e. the axial valve 112) closes the axial aperture 111, so as to prevent the drilling mud from flowing through the same axial aperture 111.

Axial valve 112 is included in a valve assembly 1000 (FIGS. 5-6).

In addition to the axial valve 112, the valve assembly 1000 comprises: a protection bushing 1010; a retaining ring 1020 (e.g. a so-called "Seeger ring"); a structural annular element 1030, preferably formed of three parts; an expansion annular element 1040; an axial tightening element 1050; a swivel 1060, to which the axial valve 112 is mounted; a support element 1070.

The substantially cylindrical tube 110 has a radial aperture 113 for radial mud feeding.

The substantially cylindrical tube 110 further comprises a radial valve 114 for selectively opening said radial aperture 113.

In one embodiment, the radial valve 114 can be realized as a second flapper which is operable between a vertical orientation and a horizontal orientation.

In the horizontal orientation, the second flapper (i.e. the radial valve 114) leaves the radial aperture 113 open, so that the drilling mud can flow in radial direction into the inner space of the substantially cylindrical tube 110 and then through the drill pipe 200 to the drilling bit 40.

In the vertical orientation, the second flapper (i.e. the radial valve 114) closes the radial aperture 113, so as to prevent the drilling mud from flowing through the same radial aperture 113.

Radial valve 114 is included in a valve assembly 2000 (FIGS. 5, 7 and 10).

In addition to the radial valve 114, the valve assembly 2000 comprises: a gasket 2010; a support element 2020; a blocking element 2030 which prevents the unscrewing of the support element 2020.

From a practical point of view, as will be disclosed in greater detail in the following, the axial aperture 111 and the radial aperture 113 are open/close in a substantially alternative way: when the axial valve 112 is in the vertical orientation (and the axial aperture 111 is open), the radial valve 114 is in the vertical orientation (and the radial aperture 113 is closed); when the axial valve 112 is in the horizontal orientation (and the axial aperture 111 is closed), the radial valve 114 is in the horizontal orientation (and the radial aperture 113 is open).

It has to be noted that the axial valve 112 and/or the radial valve 114 can be realized as valves other than flappers (e.g. ball valve(s)).

The continuous circulation sub 100 further comprises a sleeve 120.

The sleeve 120 partly surrounds the substantially cylindrical tube 110. This means that the sleeve 120 deploys around the substantially cylindrical tube 110 basically along a 360° angular extension, but has an axial length smaller than the axial length of the substantially cylindrical tube 110.

The sleeve 120 has at least one radial port 121. Preferably, the sleeve 120 has more than one radial port, for example three, angularly equally arranged, radial ports 121, 122, 123 (FIG. 10).

The continuous circulation sub 100 further comprises one or more bearing elements 130, 135 radially interposed between the substantially cylindrical tube 110 and the sleeve 120.

Said one or more bearing elements 130, 135 allow mutual rotation between the substantially cylindrical tube 110 and the sleeve 120.

Preferably, said one or more bearing elements 130, 135 comprise an upper bearing element 130 and a lower bearing element 135.

The upper bearing element 130 is arranged at a top section of the sleeve 120; the lower bearing element 135 is arranged at a bottom section of the sleeve 120.

The first and/or second bearing element 130, 135 can be realized as radial ball bearing(s).

The sleeve 120 has a substantially cylindrical upper portion 124 and a tapered lower portion 125.

The tapered lower portion 125 has a top end 125' having an outer diameter corresponding to an outer diameter of the substantially cylindrical upper portion 124.

The tapered lower portion 125 has a bottom end 125" having an outer diameter smaller than the outer diameter of the top end 125' of the tapered lower portion 125.

Preferably, the substantially cylindrical upper portion 124 and the tapered lower portion 125 are axially adjacent.

Preferably, said top section—at which the upper bearing element 130 is arranged—is located at the top of said upper portion 124.

Preferably, said bottom section—at which the lower bearing element 135 is arranged—is located at the bottom of said tapered lower portion 125.

The continuous circulation sub 100 comprises an axially slidable valve 140.

The axially slidable valve 140 includes an annular element 141 radially interposed between the sleeve 120 and the substantially cylindrical tube 110, and an active element 142 coupled to the annular element 141.

The annular element 141 has an axial length that is smaller than an axial length of the sleeve 120.

The axial length of the annular element 141 is sufficient to cover and close the radial aperture 113 of the substantially cylindrical tube 110.

The active element 142 can be realized, for example, as a coil spring, having for example a top end fastened to or in abutment with a top wall of the sleeve 120 and a lower end engaged with or in abutment with a top profile of the annular element 141.

The axially slidable valve 140 is drivable between an obstruction condition, wherein the annular element 141 closes the radial aperture 113, and an enabling condition, wherein the annular element 141 does not close the radial aperture 113.

The active element 142 tends to maintain the annular element 141 in a position facing the radial aperture 113, so as to cover and close the latter. In other words, the active element 142 tends to maintain the axially slidable valve 140 in the obstruction condition.

In practical terms, in the obstruction condition the active element 142 is in a rest condition. In such rest condition, the active element 142 can be preloaded, depending on the working conditions of the system 1.

Upon exertion of a proper force—that will be disclosed in the following—the annular element 141 axially slides upwardly and compresses the active element 142. When the force is not exerted anymore, the active element 142 causes the annular element 141 to axially slide downwardly, back in the initial position, corresponding to the rest condition of the active element 142.

The drill pipe 200 has a top end 210.

The substantially cylindrical tube 110 of the continuous circulation sub 100 is integrally engaged to the top end 210 of the drill pipe 200.

In more details, the substantially cylindrical tube 110 has a bottom end 110*a* that can be directly connected to the top end 210 of the drill pipe 200.

Depending on the working conditions of the system 1, one or more drilling assemblies can be interposed between the bottom end 110*a* of the substantially cylindrical tube 110 and the top end 210 of the drill pipe 200.

For the sake of simplicity, only one drill assembly 30 is shown in the attached drawings.

System 1 further comprises a mud circulation system 300 (FIG. 1).

The mud circulation system 300 provides drilling mud to the drilling bit 40, and receives the returning drilling mud (also containing cuttings) from the annulus A formed by the drill pipe 200 and the well's lateral, substantially cylindrical, surface.

Preferably the mud circulation system 300 comprises a first conduit 310, which brings drilling mud to the top of the continuous circulation sub 100. In particular, the first conduit 310 brings drilling mud to the axial aperture 111 of the substantially cylindrical tube 110.

The mud circulation system 300 further comprises a second conduit 320, which brings drilling mud to the radial aperture 113 of the substantially cylindrical tube 110.

The mud circulation system 300 comprises a pump 340, which causes the drilling mud to flow through the first conduit 310 or the second conduit 320, so that the same drilling mud can reach the drilling bit 40 during perforation.

The second conduit 320 can be selectively connected either to the pump 340 or be a branch departing from the first conduit 310.

The drilling mud flowing in the first/second conduit 310, 320 is previously stored in a reservoir 350, which is included in the mud circulation system 300.

The mud circulation system 300 further comprises a third conduit 330.

The third conduit 330 is in fluid communication with the annulus A for receiving the drilling mud returning from the same. Typically, the returning mud conveys cuttings/debris generated by the drilling operation.

The mud received through the third conduit 330 is provided to a shale-shaker station 360, wherein the fluid part of the returning mud is separated from the cuttings and debris.

The filtered mud is then stored in the reservoir 350 and can be inputted again in the continuous circulation sub 100.

In FIG. 1, the downward arrows on the sub 100 and drill pipe 200 represent the mud flow supplied to the drilling bit 40, while the upward arrows on the annulus A represent the mud flow returning to the surface.

Note that FIG. 1 represents the above-described elements in a schematic manner, without necessarily observing the actual proportions between the dimensions of such elements.

According to the invention, the continuous circulation and rotation drilling system 1 further comprising a clamp device 400 (FIGS. 2-5, 8-9, 11).

The clamp device 400 has the task to allow continuous rotation (of the drill pipe 200) and circulation (of the mud) when a new drill assembly has to be interposed between the top drive 20 and the drill assembly 30.

The clamp device 400 comprises a main body 410.

The main body 410 has a radially inner axially open cylindrical hollow space 420' defining an inner housing 420.

The main body 410 is formed by a first part 430 and a second part 440.

The main body 410 is drivable between an open configuration, wherein the first part 430 and second part 440 are spaced apart, and a closed configuration wherein the first part 430 and the second part 440 are joined together to form said inner housing 420.

Preferably, the inner housing 420 has one or more portions having a shape substantially complementary with respect to respective parts of the lower portion 125 of the sleeve 120.

When the sleeve 120 is enclosed in the inner housing 420, the sleeve 120 is blocked by the inner housing 420 and the substantially cylindrical tube 110 can rotate with respect to the sleeve 120 and with respect to the main body 410. Preferably, this is permitted by the aforementioned bearing elements 130, 135.

Preferably, said one or more portions of the inner housing 420 comprise a first portion 421 and a second portion 422.

Each of the first portion 421 and second portion 422 is coupled to a respective first and second seal 423, 424.

The first and second seal 423, 424 are energized by the lower tapered portion 125 of the sleeve 120 when the latter is fitted in the first and second portions 421, 422 of the inner housing 420.

Preferably, the inner housing 420 has a radially enlarged portion 425, arranged between the first portion 421 and the second portion 422.

As will be clearer in the following, the radially enlarged portion 425 can form a region in which the drilling mud (coming from the mud circulation system 300, in particular through the second conduit 320) can flow and reach the inner hollow space of the substantially cylindrical tube 110 through the radial opening 411, the at least one radial port 121, 122, 123 of the sleeve 120 and the radial aperture 113 of the substantially cylindrical tube 110.

The clamp device 400 comprises one or more actuators 450 configured to drive the main body 410 in the open and closed configuration.

For example, the clamp device 400 can comprise two actuators 450; the actuators 450 are preferably arranged at diametrically opposite positions. In one embodiment, actuators 450 are pneumatic actuators.

Preferably, each actuator 450 comprises a base body 451 and a movable cylinder 452. The base body 451 houses a mechanism which, when actuated, causes the movable cylinder to move, according to a rectilinear trajectory, with respect to the base body 450.

For example, the base body 451 of each actuator 450 can be mounted on the first part 430 of the main body 410; the movable cylinder 452 has a first end (not shown) coupled to the base body 451, and a second end 452' engaged to the second part 440 of the main body 410.

When the actuators 450 are activated, mutual movement of the first part 430 and second part 440 of the main body 410 is caused.

In particular, when the second end 452' of the movable cylinder 452 moves away from the base body 451, the first part 430 and the second part 440 of the main body 410 are moved away from each other. In this way, the main body 410 of the clamp device 400 is brought into the open configuration.

When the second end 452' of the movable cylinder 452 moves closer to the base body 451, the first part 430 and the second part 440 of the main body 410 are moved closer to each other. In this way, the main body 410 of the clamp device 400 is brought into the closed configuration.

The clamp device 400 comprises one or more actuating groups 460 mounted to said main body 410.

Figure 12:
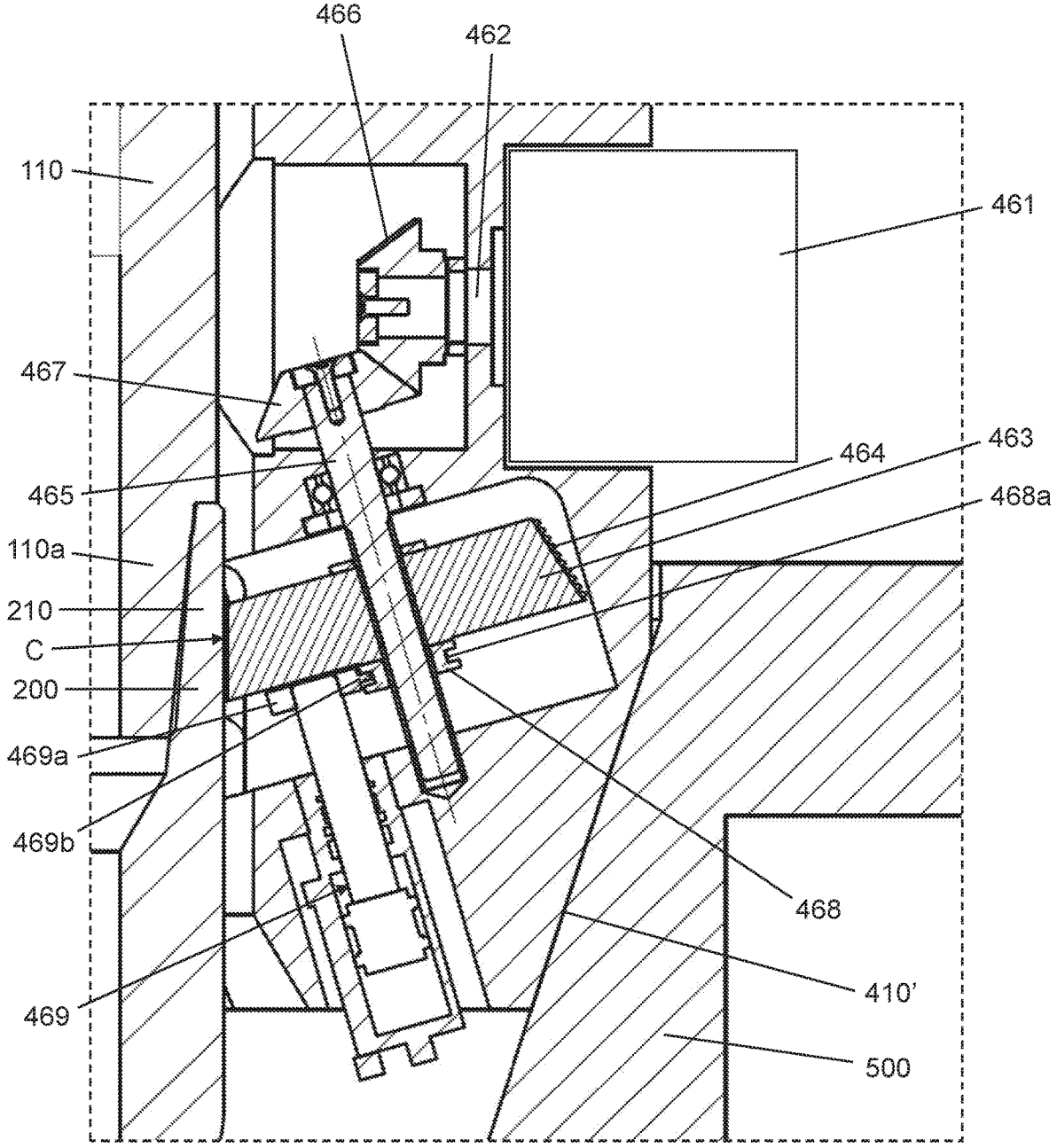
FIG. 12 is an enlarged view of details of FIG. 5.

FIG. 12 shows one of the actuating groups 460.

Preferably, each of said one or more actuating groups 460 comprise a motor 461, having a substantially horizontal output shaft 462.

Preferably, each of said one or more actuating groups 460 comprise a roller 463, rotated by said motor 461 and having a radially outer surface 464.

Preferably, each of said actuating groups 460 comprise a roller shaft 465, on which said roller 463 is fitted.

Preferably, each of said actuating groups 460 comprises a first bevel gear 466 mounted on the output 462 shaft of the motor 461.

Preferably, each of said actuating groups 460 comprises a second bevel gear 467 mounted on the roller shaft 465 and coupled to the first bevel gear 466.

Preferably, the roller 463 is axially slidable along said roller shaft 465.

Preferably, each of said actuating groups 460 comprises a supporting element 468 arranged on the roller shaft 465 and configured to axially drive the roller 463 along the roller shaft 465.

Preferably, each of said actuating groups comprises an auxiliary actuator 469 configured to axially displace the supporting element 468.

Preferably, the supporting element 468 has a groove 468*a* formed on an outer surface of the same supporting element 468.

Preferably, the auxiliary actuator 469 comprises a rectilinearly moving element 469*a* (e.g. a support bracket), the latter having a protrusion 469*b*, said protrusion 469*b* being coupled to the groove 468*a* formed on the outer surface of the supporting element 468.

Preferably, the roller shaft 465 has a longitudinal axis inclined with respect to a longitudinal axis of the substantially cylindrical tube 110 and the drill pipe 200.

Figure 13:
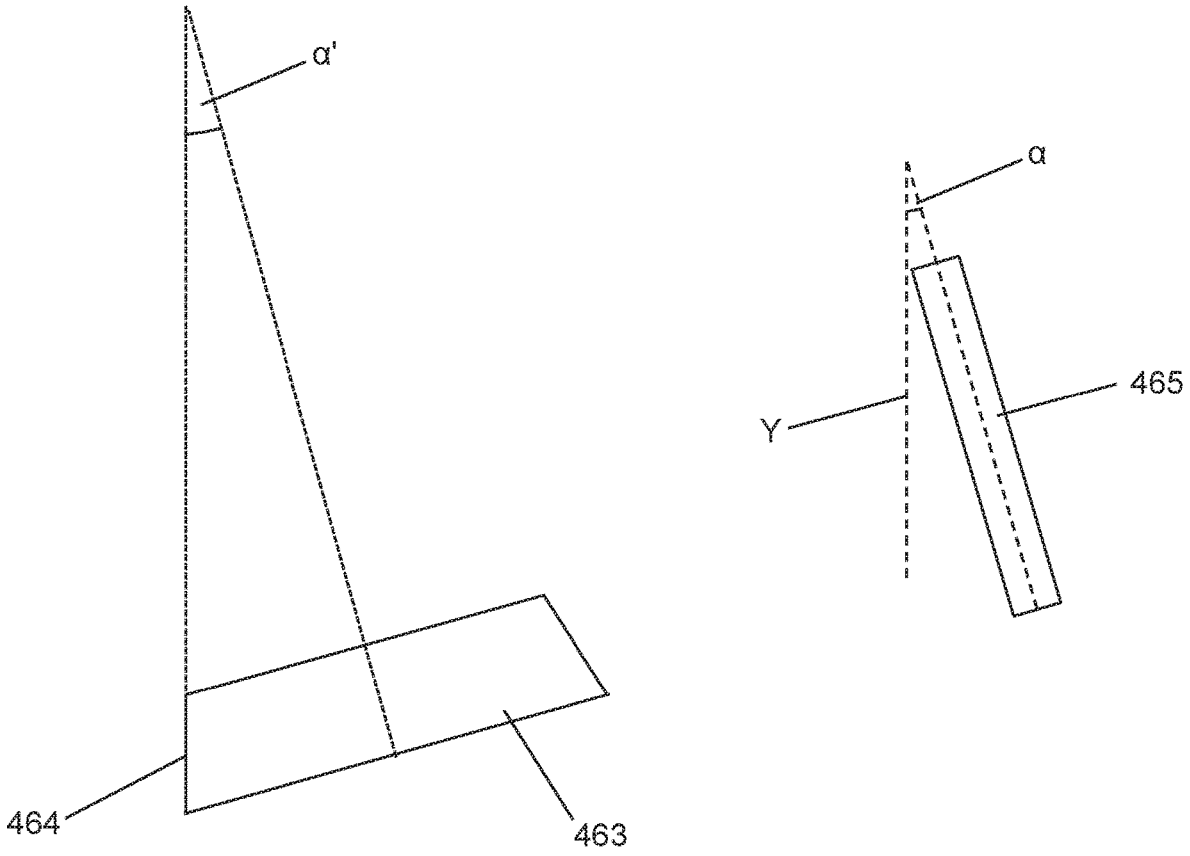
FIG. 13 is a schematic representation of some details of FIG. 5.

Preferably, the outer surface 464 of the roller 463 has a tapered shape. The profile of the outer surface 464 facing the drill pipe 200 is parallel to the longitudinal axis of the same drill pipe 200. In other terms, the roller shaft 465 is inclined with respect to the vertical direction Y (the latter being parallel to the longitudinal axis of the drill string 200) by an angle $\alpha$ that matches the tapering angle $\alpha'$ of the outer surface 464 of the roller 463. Angles $\alpha$, $\alpha'$ are schematically shown in FIG. 13.

Figure 4:
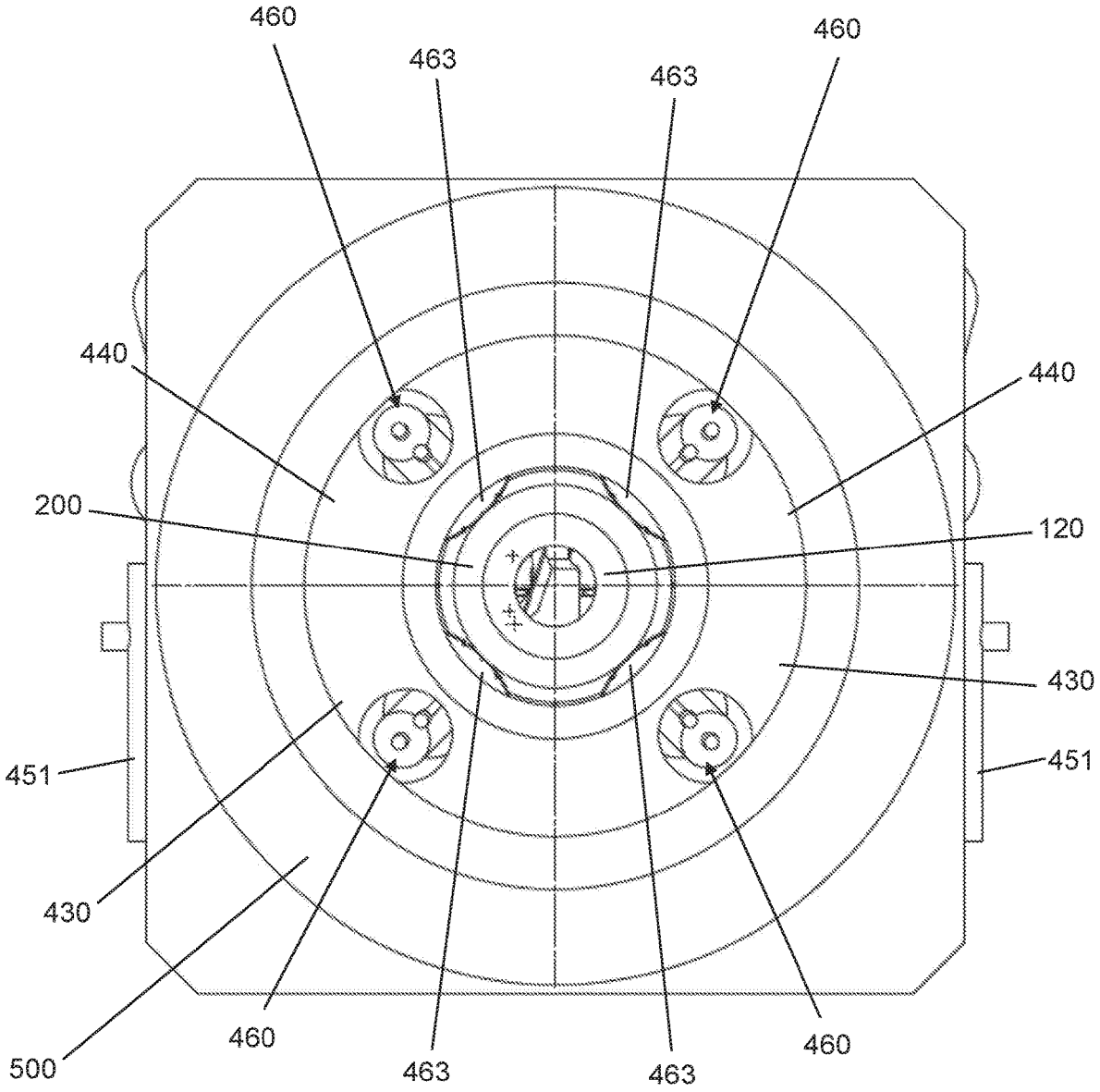
FIG. 4 is a bottom view of the portion shown in FIG. 2.

In one embodiment, as schematically shown in FIG. 4, the clamp device 400 comprises four actuating groups 460.

It is however envisaged that the number of actuating groups can be lower or higher.

Each actuating group 460 preferably has the features disclosed hereabove.

Preferably, the main body 410 has a bottom tapered section 410' for fitting in a master bushing 500 of a rotary table.

The main body 410 has a radial opening 411 configured for receiving a radial flow of drilling mud. In particular, the radial opening 411 is configured for receiving the mud flow coming from the second conduit 320 of the mud circulation system 300.

Preferably, the main body 410 further comprises one or more engagement protrusions 491-494.

For example, four engagement protrusions 491-494 can be provided.

The engagement protrusions 491-494 can be used by an external lifting/lowering system (not shown) in order to engage the clamp device 400 and lift/lower the same, preferably when switching between the first and second condition of the system 1 (that will be disclosed hereinafter) has to be performed.

In one embodiment, each of the engagement protrusion(s) 491-494 is provided with a respective through hole, for coupling with respective hook(s) of said lifting/lowering system.

According to the invention, the continuous circulation and rotation drilling system 1 is drivable between a first condition and a second condition.

In the first condition, the drill assembly 30 and the clamp device 400 are mutually disconnected.

In more details, when the continuous circulation and rotation drilling system 1 is in the first condition, the main body 410 of the clamp device 400 is in the open configuration.

Preferably, in the first condition, the main body 410 of the clamp device 400 rests on the master bushing 500 of the rotary table. In fact, the first part 430 and the second part 440 are spaced apart so that the bottom tapered section 410' cannot fit into the master bushing 500.

In the first condition, the drill assembly 30 is rotated by the top drive 20.

In the first condition, the axial valve 112 is open and the mud circulation system 300 feeds mud through the axial aperture 111 of the continuous circulation sub 100, preferably through the first conduit 310.

In the first condition, the radial valve 114 closes the radial aperture 113.

Preferably, when the continuous circulation and rotation drilling system 1 is in the first condition, the active element 142 maintains the axially slidable valve 140 in the obstruction condition.

Likewise, when the continuous circulation and rotation drilling system 1 is in the first condition, the radial aperture 113 is preferably obstructed by both the radial valve 114 and the axial slidable valve 140 (in particular the annular element 141). The axial slidable valve 140 may operate as a backup obstructing element in case of failure of the radial valve 114.

In a nutshell, the first condition of the continuous circulation and rotation drilling system 1 is a standard working condition of a drilling system.

In this condition, driven by the top drive 20, the drilling bit 40 drills the subsoil, and progressively increases the depth of the well.

When the drilling bit 40 reaches such a depth that insertion of a further drill assembly 30 becomes necessary, the system 1 is driven into the second condition.

To this aim, the main body 410 of the clamp device 400 is lifted (arrows "lift up" in FIG. 9) from the rest position shown in FIG. 9, and brought in the closed configuration around the drill assembly 30.

In more details, the first and second part 430, 440 of the main body 410 are pulled together by means of the actuators 450, so as to form the inner housing 420.

Note that, at this stage, the sleeve 120 is not locked in the inner housing 420 yet: the sleeve 120 is now in a position higher, with respect to the main body 410, than the blocking position shown in FIG. 5, so that the drill assembly 30 and the main body 410 can be mutually displaced in the vertical direction.

Then the clamp device 400 is lowered, so that the bottom tapered section 410' of the main body 410 is fitted in the master bushing 500.

The drill assembly 30 is not dragged by the latter movement of the clamp device 400 since, as said, the drill assembly 30 and the main body 410 are not mutually constrained yet.

The drill assembly 30 is now displaced downwardly, so that the sleeve 120 (in particular, the tapered lower portion 125) is fitted in the inner housing 420, in particular in the first and second portion 421, 422 thereof.

The continuous circulation sub 100 and the drill pipe 200 are now supported by the clamp device 400 and the master bushing 500.

Since the main body 410 of the clamp device 400 is in the closed configuration, the radially enlarged portion 425 of the inner housing 420 defines a mud flowing chamber.

Such mud flowing chamber is tightly closed by the aforesaid first and second seals 423, 424. In particular, the force (i.e. the weight force) exerted by continuous circulation sub 100 and the drill pipe 200 energizes the first and second seal 423, 424, thereby providing a tight closure to the mud flowing chamber.

In this condition, the radial ports 121, 122, 123 of the sleeve 120, the radial aperture 113 of the substantially cylindrical tube 110 and the radial opening 411 of the main body 410 are in fluid communication with each other and, in particular, are in fluid communication with said mud flowing chamber.

A progressive reduction of the mud axial flow is then started, until no mud flows through the axial aperture 111 anymore.

Radial flow of the mud is activated in the meanwhile, so that the drilling mud flows though the radial opening 411, the radial ports 121, 122, 123 and the radial aperture 113.

The radial flow of mud through the radial aperture 411 of the main body 410 generates a pressure difference that causes the annular element 141 to axially slide upwardly and drives the axially slidable valve 140 in the enabling condition.

The radial flow of mud further acts on the radial valve 114 so as to push it to an open condition.

The drilling mud propagates in the mud flowing chamber formed by the radially enlarged portion 425 of the inner housing 420. Since the radial ports 121, 122, 123 are in fluid communication with the mud flowing chamber, the drilling mud flows through such radial ports 121, 122, 123 so as to reach the radial aperture 113 and the inner hollow of the substantially cylindrical tube 110.

When the drilling mud entirely flows through the radial aperture 113 and no drilling mud flows through the axial aperture 111 anymore, then the top drive 20 is disengaged from the continuous circulation sub 100.

Then the roller 463 of each actuating group 460 is arranged in abutment with the drill pipe 200, in a condition of appropriate friction. The radially outer surface 464 of the roller 463 is now in contact with the drill pipe 200 in a contact region C.

As schematically shown in FIG. 13, the outer surface 464 of the roller 463 has a profile, in the contact region C, that is parallel to the longitudinal axis of the substantially cylindrical tube 100 and the drill pipe 200.

The motor 462 of each actuating group 460 can then be activated, so as to cause rotation of the drill pipe 200—and of the substantially cylindrical tube 110 connected thereto.

Now the continuous circulation and rotation drilling system 1 is in the second condition.

In a nutshell:

the main body 410 of the clamp device 440 is in the closed configuration and the drill assembly 30 is partly enclosed in the inner housing 420;

the top drive 20 is not connected to the drill assembly 30 anymore;

the axial valve 112 closes the axial aperture 111 of the continuous circulation sub 100;

the radial valve 114 is open and the mud circulation system 300 feeds drilling mud through the radial opening 411 of the main body 410 of the clamp device 400 and the radial aperture 113 of the continuous circulation sub 100;

the actuating groups 460 are activated to rotate the drill pipe 200 around its longitudinal axis.

Now, by means of a torque wrench (not shown), the new drill assembly can be engaged to the top drive 20.

The new drill assembly is then lowered and attached to the top end of the drill assembly 30.

A process for bringing the system 1 back to the first condition can be then carried out.

In particular, the mud flow is progressively directed back through the top drive 20 and the top end of the new drill assembly, while the radial flow is progressively reduced.

Given the diminishing intensity of the radial flow, the radial valve 114 tends to return to the closed condition, and the annular element 141 of the axially slidable valve 140 is pushed downwardly by the active element 142, since the radial flow cannot contrast anymore the action exerted by the same active element 142 on the annular element 141.

The assembly formed by the new drill assembly and the drill assembly 30 is now hoisted; the main body 410 of the clamp device 400 can be lifted, driven into the open configuration and put to rest on the master bushing 500 (FIG. 9).

The system 1 is now in the first condition, and drilling can be performed by means of the top drive.

What is claimed is:

1. Continuous circulation and rotation drilling system, comprising:

a top drive;

a mud circulation system;

a drill assembly, including a continuous circulation sub and a drill pipe;

the continuous circulation sub including: a substantially cylindrical tube having an axial aperture for axial mud feeding, an axial valve for selectively opening said axial aperture, a radial aperture for radial mud feeding, a radial valve for selectively opening said radial aperture; a sleeve partly surrounding said cylindrical tube and having at least one radial port; one or more bearing elements radially interposed between said cylindrical tube and said sleeve, said one or more bearing elements allowing mutual rotation between the substantially cylindrical tube and the sleeve;

the drill pipe having a top end;

the substantially cylindrical tube of the continuous circulation sub being integrally engaged to the top end of the drill pipe;

the continuous circulation and rotation drilling system further comprising a clamp device, including:

a main body having a radially inner axially open cylindrical hollow space defining an inner housing, the main body being formed by a first part and a second part, the main body being drivable between an open configuration wherein the first part and second part are spaced apart, and a closed configuration wherein the first part and the second part are joined together to form said inner housing;

one or more actuators configured to drive the main body in the open and closed configuration;

one or more actuating groups mounted to said main body;

the main body having a radial opening configured for receiving a radial flow of drilling mud;

said continuous circulation and rotation drilling system being drivable between a first condition and a second condition, wherein in the first condition:

said drill assembly and said clamp device are mutually disconnected, said drill assembly is rotated by said top drive, said axial valve is open and said mud circulation system feeds mud through the axial aperture of the continuous circulation sub;

said radial valve closes said radial aperture;

in the second condition:

the main body of the clamp device is in the closed configuration and the drill assembly is partly enclosed in said inner housing;

the top drive is disconnected from the drill assembly;

the axial valve closes the axial aperture of said continuous circulation sub;

the radial valve is open and the mud circulation system feeds drilling mud through the radial opening of the main body of the clamp device and the radial aperture of the continuous circulation sub;

said one or more actuating groups are activated to rotate the drill pipe around its longitudinal axis.

2. System according to claim 1 wherein said sleeve has a substantially cylindrical upper portion and a tapered lower portion, said inner housing having one or more portions having a shape substantially complementary with respect to respective parts of the lower portion of said sleeve wherein, when said sleeve is enclosed in said inner housing, said sleeve is blocked by said inner housing and said cylindrical tube can rotate with respect to said sleeve and with respect to said main body.

3. System according to claim 2 wherein said one or more portions of the inner housing comprise a first portion and a second portion, each of said first portion and second portion being coupled to a respective first and second seal, said first and second seal being energized by the lower tapered portion of said sleeve when the latter is fitted in the first and second portions of said inner housing.

4. System according to claim 3 wherein said inner housing has a radially enlarged portion, arranged between said first portion and said second portion, said radially enlarged portion defining a mud flowing chamber when the continuous circulation and rotation drilling system is in the second condition.

5. System according to claim 4 wherein when said continuous circulation and rotation drilling system is in the second condition, the at least one radial port of said sleeve, the radial aperture of said substantially cylindrical tube and the radial opening of said main body are in fluid communication with said mud flowing chamber.

6. System according to claim 4 wherein when said continuous circulation and rotation drilling system is in the second condition, said first and second seal provide a tight closure to a region in which said mud flowing chamber extends.

7. System according to claim 1 wherein, when said continuous circulation and rotation drilling system is in the second condition, the at least one radial port of said sleeve, the radial aperture of said substantially cylindrical tube and the radial opening of said main body are in fluid communication with each other.

8. System according to claim 1 wherein said continuous circulation sub comprises an axially slidable valve, including an annular element radially interposed between the sleeve and the cylindrical tube, and an active element coupled to said annular element.

9. System according to claim 8 wherein the axially slidable valve is drivable between an obstruction condition, wherein the annular element closes said radial aperture, and an enabling condition, wherein the annular element does not close the radial aperture.

10. System according to claim 9 wherein, when the continuous circulation and rotation drilling system is in the first condition, said active element maintains the axially slidable valve in the obstruction condition and, when the continuous circulation and rotation drilling system is in the second condition, a pressure exerted by the mud flow through the radial aperture of the main body causes the annular element to axially slide and drives the axially slidable valve in the enabling condition.

11. System according to claim 1 wherein said one or more bearing elements comprise a first bearing element located at a top section of said sleeve, and a second bearing element located at a bottom section of said sleeve.

12. System according to claim 1 wherein each of said one or more actuating groups comprise:

a motor, having a substantially horizontal output shaft;

a roller, rotated by said motor and having a radially outer surface, wherein, when the continuous circulation and rotation drilling system is in the second condition, the radially outer surface of said roller is in contact with the drill pipe in a contact region and causes a rotation of said drill pipe.

13. System according to claim 12 wherein each of said actuating groups comprise:

a roller shaft, on which said roller is fitted;

a first bevel gear mounted on the output shaft of said motor;

a second bevel gear mounted on the roller shaft and coupled to the first bevel gear.

14. System according to claim 13 wherein said roller is axially slidable along said roller axis, each actuating group comprising:

a supporting element arranged on said roller shaft and configured to axially drive said roller along said roller shaft;

an auxiliary actuator configured to axially displace said supporting element.

15. System according to claim 14 wherein:

said supporting element has a groove formed on an outer surface of said supporting element;

said auxiliary actuator comprises a rectilinearly moving element, the latter having a protrusion, said protrusion being coupled to said groove.

16. System according to claim 13 wherein said roller shaft has a longitudinal axis inclined with respect to a longitudinal axis of said substantially cylindrical tube and said drill pipe, wherein the outer surface of said roller has a tapered shape such that, when the continuous circulation and rotation drilling system is in the second condition, the outer surface of the roller has a profile, in said contact region, that is parallel to the longitudinal axis of said substantially cylindrical tube and said drill pipe.

17. System according to claim 1 wherein said main body has a bottom tapered section for fitting in a master bushing of a rotary table.

* * * * *